United States Patent [19]

Koutonen

[11] 4,341,586

[45] Jul. 27, 1982

[54] ARRANGEMENT FOR WRAPPER FEEDING TO BIG PAPER ROLLS

[75] Inventor: Pauli Koutonen, Järvenpää, Finland

[73] Assignee: Oy Wartsila Ab, Helsinki, Finland

[21] Appl. No.: 195,391

[22] Filed: Oct. 9, 1980

[30] Foreign Application Priority Data

Oct. 19, 1979 [FI] Finland ..... 793239

[51] Int. Cl.[3] ..... B32B 3100

[52] U.S. Cl. ..... 156/518; 53/389; 156/554

[58] Field of Search ..... 53/203, 211, 214, 389; 242/58; 206/389; 156/428, 457, 517, 518, 554; 428/906

[56] References Cited

U.S. PATENT DOCUMENTS 1,840,222 1/1932 Brown ..... 53/211 X
2,893,191 7/1959 Lancaster ..... 156/457 X
3,290,861 12/1966 Prager ..... 53/214
3,342,014 9/1967 Prager ..... 53/214

*Primary Examiner*—Henry F. Epstein
*Attorney, Agent, or Firm*—McAulay, Fields, Fisher, Goldstein & Nissen

[57] ABSTRACT

An arrangement for selecting and feeding a wrapper from a storage unit to a big paper roll or the like. The storage unit comprises several wrapper rolls of different axial length and separate feeding means for each wrapper. The feeding means are in a substantially vertical line and there is a guiding unit for guiding the selected wrapper to a roll wrapping station. The feeding means operate as the main wrapper pulling and feeding devices of the arrangement. The guiding unit, which is provided with means for transversely cutting the wrapper passing therethrough, is movable mainly vertically and can be selectively positioned in front of any of the feeding means, preferably very close to them.

6 Claims, 3 Drawing Figures

ARRANGEMENT FOR WRAPPER FEEDING TO BIG PAPER ROLLS

Figure 1:
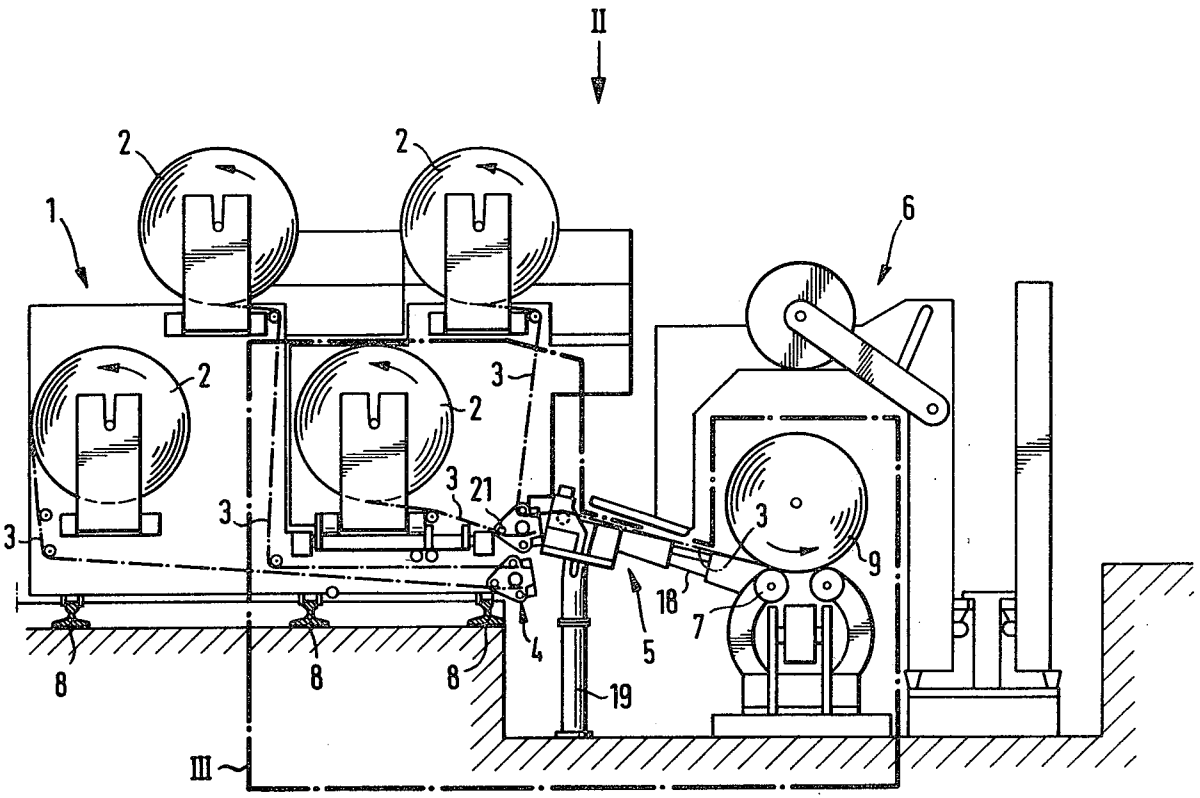

The invention relates to an arrangement for feeding a wrapper to a big paper roll or the like, which arrangement comprises a storage unit for wrapper rolls of different axial length, separate feeding means for each wrapper in said storage unit, said feeding means being arranged in a substantially vertical line, and means for feeding and further guiding a selected wrapper to a roll wrapping station.

One difficulty in the wrapping of big paper rolls is that rolls of different axial length require wrappers of different width. The axial length of the rolls brought for wrapping varies irregularly, and hence, it must be possible to change rapidly from one wrapper width to another, because otherwise the wrapping phase may form a bottleneck in the production. A flexible wrapping system is of particular importance when trying to increase the capacity and the automatization level of a roll packaging line.

In known arrangements, the feeding of wrappers of different width takes place by means of a relatively great number of separate roll nips, located one over another. From these nips the wrappers descend to a fixed guiding unit. This unit is located below the roll nips and is provided with a wrapper cutting device. Hence, the cutting of the wrapper takes place at a considerable distance from the wrapper feeding nips. This means that there will be wrapper strips between the feeding nips and the guiding unit, which hampers the work when changing from one wrapper to another. To overcome this, according to the known art, the feeding nips are provided with a reverse pull device, which increaes the complexibility of the arrangement considerably. It is also possible to provide each wrapper feeding nip with its own cutting device. In this case, the guiding unit can be used to serve all the feeding nips and for glueing the tail end of the cut wrapper. This solution, however, is even more expensive than the first mentioned one. Another difficulty is the application of the glue precisely enough at the wrapper tail end.

In known arrangements, there is usually no exact regulation of the wrapper tension during the wrapping operation. This is due to the fact that no means for indicating the real tension of the wrapper can be easily installed.

The object of the invention is to provide an improved arrangement for feeding wrappers of different width to a roll wrapping station, in which arrangement the drawbacks of the known art are eliminated and which can be flexibly applied to a highly mechanized and automatized roll packaging line.

The invention is characterized in that said feeding means comprise, as known per se, at least one wrapper feeding drive roll, that said feeding means are arranged to operate as the main wrapper pulling and feeding devices of said arrangement, that the arrangement comprises a guiding unit provided with means for transversely cutting the wrapper fed therethrough, said guiding unit being movably mainly vertically and arranged to be selectively positioned in front of any of said feeding means, preferably very close thereto, for guiding a selected wrapper from said storage unit to wrapper receiving members in said roll wrapping station. By using a guiding unit which is movable from one feeding means to another, the wrapper will be cut very close to the feeding means. Hence, no reverse pull devices are needed at all, but still only one wrapper cutter device is needed. Due to the short distance between the feeding means and the guiding unit, the supply of wrapper from the storage unit all the way to the paper roll to be wrapped takes place fast and infallibly. This is true also for the change from one wrapper size to another, and hence, the action of the entire system is faster and more reliable than in known arrangements.

The arrangement can with advantage be simplified so, that the feeding means comprise roll pairs arranged to form feed units including one stationary drive roll and two load rolls located at opposite sides of the drive roll. Both load rolls are movable into contact with the drive roll to form a roll nip. In this manner only one drive roll is required for two roll nips. By arranging the two load rolls in a tiltable support frame, a roll nip is made ready for action merely by tilting said support frame.

If a great number of different wrapper sizes is needed, the storage unit can be divided into two or several sections, preferably located side by side. The selection of the proper section is then carried out by moving the storage unit in the axial direction of the wrapper rolls. In this way the guiding unit has to be movable basically only vertically.

In order to obtain a regulation of the tension of the wrapper, the guiding unit can be arranged to be influenced by the wrapper tension, for example so, that the wrapper web bends when passing the guiding unit. By providing the guiding unit with a measuring gauge at the bending point of the wrapper web, the actual tension of the wrapper can easily be watched. By arranging the signal of the gauge to regulate the speed of the drive motor of the wrapper feeding drive roll, a proper tension in the wrapper web can easily be obtained.

The guiding unit can also with advantage be provided with a glueing unit, which can be located, for example, in connection with the wrapper cutting device, so that the wrapper tail end is provided with glue when the wrapper is cut off. The glueing unit is preferably located at a fixed distance from the cutting device. In this way the glue is always placed exactly in right position at the tail end of the cut wrapper.

Figure 2:
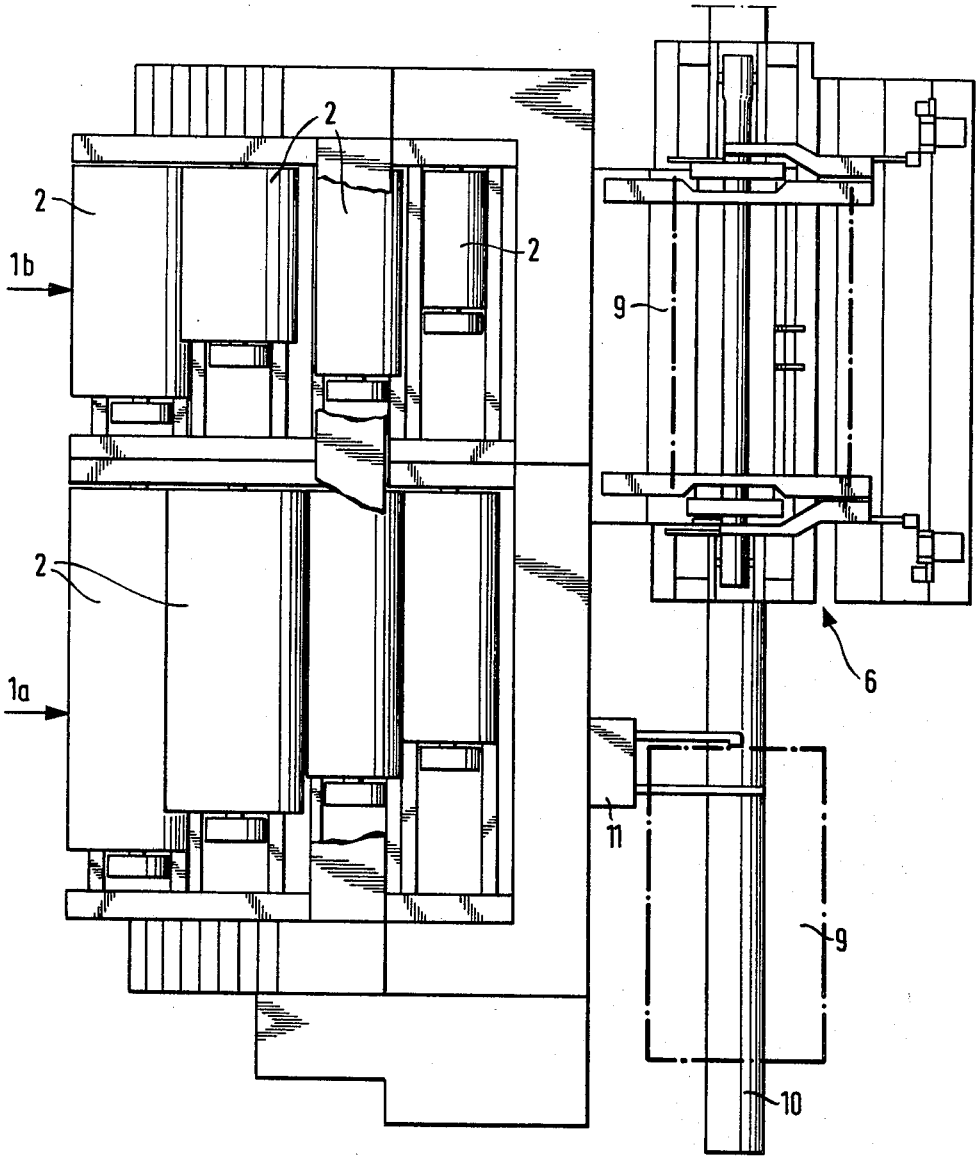
Figure 3:
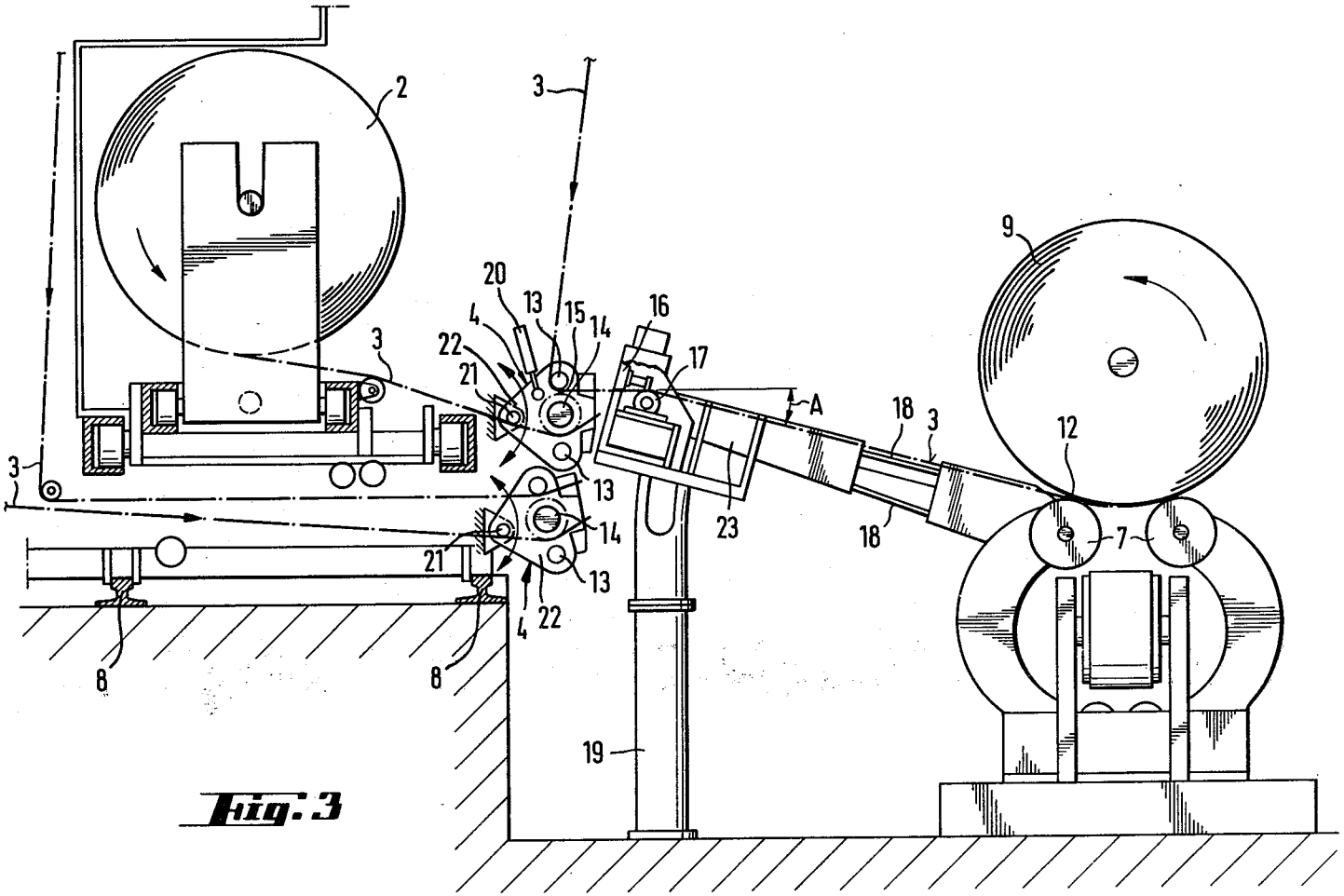

In the following, the invention will be described more in detail, with reference to the attached drawing, in which FIG. 1 shows a side view of an arrangement according to the invention, FIG. 2 shows a top view of the arrangement of FIG. 1, FIG. 3 shows the portion III of FIG. 1 on a larger scale.

In the drawing, reference numeral 1 refers to a storage unit for wrapper rolls 2 of different axial length, which unit in this case is divided in two sections 1*a* and 1*b*, as shown in FIG. 2. The wrapper 3 runs from rolls 2 to feed units 4, from which a mainly vertically movable guiding unit 5 picks up the wrapper and guides it into a nip 12 of a roll wrapping station 6 between its support rolls 7 and a paper roll 9 to be wrapped. Paper rolls 9 are brought to wrapping station 6 along a track 10. Storage unit 1 can be moved along rails 8 so that any of the sections 1*a* or 1*b* of the storage unit can be placed in front of guiding unit 5. Both sections 1*a* and 1*b* comprise their own feed units 4.

Feed unit 4 comprises a drive roll 14 and, journalled at opposite sides thereof in a frame 22, are load rolls 13.

Frame 22 can be tilted around an axis 21 by means of a power cylinder 20, as shown by arrows in FIG. 3. This brings one of the load rolls 13 of the feed unit 4 into contact with the drive roll 14 to form a wrapper feeding roll nip 15.

Guiding unit 5 comprises an end glueing and cutting device 16, a measuring gauge 17 for measuring the wrapper tension and a feed table 23 provided with conveyor straps 18. The guiding unit 5 leads the wrapper to nip 12 between the paper roll 9 and its support roll 7. When the wrapper has reached nip 12, this nip starts to pull the wrapper. Since feed table 23 is inclined an angle A (FIG. 3), the wrapper bends at measuring gauge 17, measuring the tension of the wrapper before support rolls 7. The measuring signal of gauge 17 can be arranged to regulate, by known means, the drive motor (not shown) of the operated drive roll 14, so as to maintain a proper tension in the wrapper. This may be carried out, for example, by means of braking the active feed unit 4. When a sufficient amount of wrapper has been wound around paper roll 9, the wrapping is stopped. Thereby, wrapper 3 is cut by means of the cutting part of end glueing and cutting device 16, which is movable in a cross-web direction. The end glueing and cutting device 16 is, for example, movable by means of a power cylinder. In connection with the end glueing and cutting device one or several glue nozzles can be provided (not shown) at a fixed distance from the actual cutter. These nozzles are used for tail end glueing of the wrapper in connection with the cutting, whereby a very exact positioning of the glue layer is obtained.

In practice, cutting of the wrapper takes place about 2 cm from the feed rolls. Thus, no reverse pulling is needed for the fore end of the wrapper.

After cutting the wrapper, the tail end of the wrapper is pulled through nip 12 and is thereby glued to the adjacent wrapper layer.

Guiding unit 5 is movably supported on a member 19, so that it can be lifted and lowered to take a position in front of the desired feed roll nip 15.

If the roll packaging line is provided with a measuring station 11, where the diameter, axial length and similar qualities of a paper roll are measured, the function of the arrangement can be fully automatized by known means. Thereby, the automatization should comprise selection and positioning of one of storage unit sections 1*a* and 1*b*, selection and operation of the proper feed nip 15 and positioning of the guiding unit 5 in front of the selected feed nip. A change from one feed nip 15 to another in the same feed unit 4 requires reversing the rotation of drive roll 14.

The invention is not limited to the embodiment shown, but several modifications thereof are feasible within the scope of the attached claims.

I claim:

1. An arrangement for selecting and feeding a wrapper to a big paper roll or the like, said arrangement comprising:

a storage unit containing a plurality of wrapper rolls of different axial length and including separate feeding means for each wrapper in said storage unit;

said feeding means being arranged in a substantially vertical line and comprising each, as known per se, at least one wrapper feeding drive roll, said feeding means being arranged to operate as the main wrapper pulling and feeding devices of said arrangement;

said arrangement further comprising a guiding unit receiving a selected wrapper and being provided with means for transversely cutting said wrapper;

said guiding unit being movable mainly vertically and arranged to be selectively positioned in front of and close to any of said feeding means for automatically guiding a selected wrapper from said storage unit to a roll wrapping station; thereby to avoid threading of a new wrapper end when changing to another selected wrapper from said storage unit.

2. An arrangement according to claim 1, in which said feeding means comprise roll nips arranged to form wrapper feed units, comprising a stationary drive roll and two load rolls located at opposite sides of said drive roll, said load rolls being movable into contact with said drive roll to form a roll nip.

3. An arrangement according to claim 2, in which said load rolls of the feed units are journalled in a tiltable frame element.

4. An arrangement according to claim 2 or 3, in which said storage unit is divided into at least two sections located side by side, each section comprising its own feeding means, and that the selection of a proper wrapper is arranged to take place by moving at least one of said storage unit sections axially relative to said wrapper rolls.

5. An arrangement according to claim 1, 2 or 3, in which said guiding unit is so located relatively to said feeding means and said roll wrapping station that there is a bend in said wrapper when it passes said guiding unit, and that there is a measuring gauge for measuring the wrapper tension at said bending point, the measuring signal of said gauge being arranged to regulate the speed of said drive roll, for maintaining a proper wrapper tension during the wrapping operation.

6. An arrangement according to claim 1, 2 or 3, in which said guiding unit is provided with a glueing unit, preferably located in connection with said wrapper cutting device, for providing, during the wrapper cutting operation, the wrapper tail end with a transverse glue layer.

* * * * *